United States Patent [19]

Burnand et al.

[11] Patent Number: 4,959,929

[45] Date of Patent: Oct. 2, 1990

[54] TOOL INSERT

[76] Inventors: Richard P. Burnand, 39 Constantia Avenue, Alan Manor, Johannesburg, Transvaal, South Africa; John Dodsworth, 1 Manor Close, Trimdon Village, County Durham, United Kingdom

[21] Appl. No.: 137,069

[22] Filed: Dec. 23, 1987

[30] Foreign Application Priority Data

Dec. 23, 1986 [ZA] South Africa ..... 86/9663

[51] Int. Cl.[5] ..... B22F 3/14

[52] U.S. Cl. ..... 51/307; 51/293; 428/565; 407/119

[58] Field of Search ..... 407/119, 120; 51/307, 51/308, 309, 293, 295; 72/146; 419/16; 428/565

[56] References Cited

U.S. PATENT DOCUMENTS

| | | | |
|---|---|---|---|
| 4,311,490 | 1/1982 | Bovenkerk | 51/307 |
| 4,334,928 | 6/1982 | Hara | 428/565 |
| 4,380,471 | 4/1983 | Lee | 51/307 |
| 4,403,015 | 9/1983 | Nakai | 428/565 |
| 4,448,591 | 5/1984 | Ohno | 51/307 |
| 4,604,106 | 8/1986 | Hall | 51/295 |
| 4,650,776 | 3/1987 | Cerceau | 51/307 |
| 4,666,466 | 5/1987 | Wilson | 51/307 |
| 4,686,080 | 8/1987 | Hara | 428/565 |
| 4,714,385 | 12/1987 | Komanduri | 51/307 |
| 4,764,434 | 8/1988 | Aronsson | 428/565 |

*Primary Examiner*—Frederick R. Schmidt
*Assistant Examiner*—Blynn Shideler
*Attorney, Agent, or Firm*—Scully, Scott, Murphy & Presser

[57] ABSTRACT

A tool insert comprising a composite diamond abrasive compact and a method of its production are provided. The composite abrasive compact is characterized by an intermediate layer between the diamond compact and the cemented carbide support. The intermediate layer consists essentially of discrete cubic boron nitride particles constituting 60 to 40 percent by volume of the intermediate layer, carbide particles, preferably tungsten carbide particles and diamond solvent, preferably cobalt. The carbide particles and diamond solvent together constitute 40 to 60 percent by volume of the intermediate layer and the diamond solvent constitutes 15 to 25 percent by volume of the carbide/solvent combination.

14 Claims, 1 Drawing Sheet

TOOL INSERT

BACKGROUND OF THE INVENTION

This invention relates to tool inserts and more particularly to tool inserts which comprise composite abrasive compacts.

A composite abrasive compact comprises an abrasive compact bonded to a cemented carbide support or substrate. The abrasive compact will invariably be a diamond or cubic boron nitride abrasive compact. Bonding between the abrasive compact and the substrate may be direct or through the medium of an interposed bonding layer.

Diamond abrasive compacts of such composite abrasive compacts consist of a layer of polycrystalline diamond (abbreviated often to PCD) which is made by subjecting individual diamond crystals to temperature and pressure conditions at which the diamond is crystallographically stable and at which direct diamond-to-diamond bonding occurs. A diamond solvent/catalyst second phase may be present to assist in the formation of the diamond-to-diamond bonding.

Composite abrasive compacts are extensively described in the patent literature and have been in commercial use for over a decade. Examples of patent specifications which describe and illustrate composite abrasive compacts are U.S. Pat. Nos. 3,743,489, 3,767,371, 4,063,909 and 3,745,623. U.S. Pat. No. 4,403,015 also describes a particular type of composite abrasive compact. This composite abrasive compact consists of a diamond or cubic boron nitride abrasive compact bonded to a cemented carbide substrate through an intermediate bonding layer less than 2 mm in thickness and comprising cubic boron nitride in an amount effective to ensure rigid bonding between the hard sintered compact and the cemented carbide substrate, but not exceeding 70 volume percent, the residual part consisting of a compound selected from the group consisting of carbides, nitrides, carbonitrides or borides of 4A, 5A, 6A transition metals of the Periodic Table, an admixture thereof, or a mutual solid solution compound thereof. The intermediate bonding layer may also contain aluminium and/or silicon and perhaps a minor quantity of binder metal such as cobalt from the cemented carbide substrate.

U.S. Pat. No. 4,604,106 describes a composite abrasive compact comprising an abrasive compact bonded to a cemented carbide support through an intermediate layer which comprises a mixture of diamond crystals and pre-cemented carbide pieces. The carbide pieces are pre-cemented and not in the form of carbide powder. The specification also states that some cubic boron nitride may be included in the intermediate layer.

U.S. patent application Ser. No. 898,612 now abandoned described a tool component comprising a composite abrasive compact in which the compact layer has two zones joined by an interlocking, common boundary. The one zone provides the cutting edge or point for the tool component while the second zone is bonded to the cemented carbide support. The second zone is produced from a mixture of ultra-hard abrasive particles and carbide particles or ultra-hard abrasive particles coarser than those used for producing the other zone. Since the second zone forms part of the abrasive compact, the ultra-hard abrasive particles present therein, be they diamond or cubic boron nitride, will contain substantial particle-to-particle bonding.

SUMMARY OF THE INVENTION

According to the invention, there is provided a tool insert comprising a diamond abrasive compact having a diamond solvent second phase and bonded to a cemented carbide support through an intermediate layer consisting essentially of discrete cubic boron nitride particles and carbide particles bonded into a coherent form by means of a bonding metal selected from cobalt, nickel, iron and alloys containing one or more of these metals, the cubic boron nitride particles constituting 60 to 20 percent by volume of the intermediate layer, the carbide particles and bonding metal together constituting 40 to 80 percent by volume of the intermediate layer and the bonding metal constituting 15 to 25 percent by weight of the carbide/metal combination.

The intermediate layer thus consists essentially of discrete cubic boron nitride particles, carbide particles and diamond solvent. Any other components such as diamond particles will be present in trace amounts only.

Further according to the invention, a method of making a tool insert as described above includes the steps of providing a body of cemented carbide, placing a mixture of cubic boron nitride particles, carbide particles and powdered bonding metal as defined above on a surface of the carbide body, the cubic boron nitride particles constituting 60 to 20 percent by volume of the mixture while the carbide particles and bonding metal together constituting 40 to 80 percent by volume of the mixture and the bonding metal constituting 15 to 25 percent by weight of the carbide/metal combination, placing a mixture of diamond particles and powdered diamond solvent on the cubic boron nitride containing mixture, and subjecting the cemented carbide body and mixtures to elevated conditions of temperature and pressure suitable to form a compact from the mixture of diamond particles and powdered diamond solvent.

DETAILED DESCRIPTION OF THE INVENTION

The tool insert of the invention is a composite diamond abrasive compact wherein the diamond compact layer is bonded to the cemented carbide support through an intermediate layer. The tool insert has several advantages over known composite diamond abrasive compacts. First, it has been found that the thermal stability of the diamond abrasive compact layer is, for reasons which are not known, better than similar prior art composite diamond abrasive compacts, i.e. those which also have a diamond solvent second phase. For example, it has been found that the diamond compact layer can withstand temperatures of up to 850° C. in an inert on non-oxidising atmosphere for 10 minutes, without any serious degradation of the diamond occurring. This means that the tool insert may be used in cutting applications where high temperatures are generated at the cutting edge. Such high temperatures are experienced, for example, in drilling applications and high speed cutting applications. Second, the coherent bonded intermediate layer is abrasion resistant and minimises undercutting by chips produced during cutting. Third, stress fractures and cracks do not form in the intermediate layer during use. The formation of such stress fractures or cracks weakens the bond between the compact and the carbide support resulting in delamination occurring during use. In this regard, it has been found essential that the bonding metal content of the carbide/metal combination be at least 15 percent by weight of that combination to avoid stress fractures and cracks forming.

The intermediate layer will typically have a thickness of about 20 microns up to 5 mm. The intermediate layer will preferably have substantially the same thickness or depth as the diamond compact layer.

The carbide particles are preferably tantalum carbide, tungsten carbide, titanium carbide, or a mixture thereof. The preferred carbide particles are tungsten carbide particles. These particles will generally be fine having an average size of less than 10 microns.

The cubic boron nitride particles will also generally be fine typically having an average size of no more than 50 microns.

The diamond solvent may be any known in the art but is preferably cobalt.

The conditions necessary to produce a diamond abrasive compact are well known in the art. The pressure applied is at least 50 kilobars and the temperature applied is at least 1400° C. These elevated temperature and pressure conditions are typically maintained for a period of up to 30 minutes. Further, the apparatus used for producing such high temperature and pressure conditions is also well known in the art.

Figure 1:
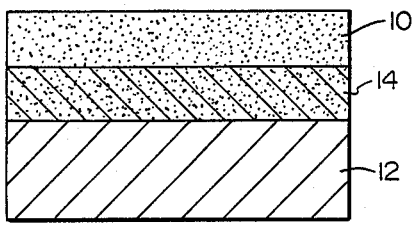
FIG. 1 illustrates a sectional side view of a tool insert of the invention.

An embodiment of the invention will now be described with reference to the accompanying drawings. Referring to these drawings, FIG. 1 illustrates a tool insert of the invention. The insert comprises a diamond abrasive compact layer 10 bonded to a cemented carbide support 12 through an intermediate bonded layer 14. The cemented carbide support 12 is preferably cemented tungsten carbide. The bonded intermediate layer 14 consists essentially of 50 percent by volume discrete cubic boron nitride particles and 50 percent by volume of a combination of tungsten carbide particles and cobalt. The cobalt is present in an amount of 20 percent by weight of the carbide/colbalt combination.

Figure 2:
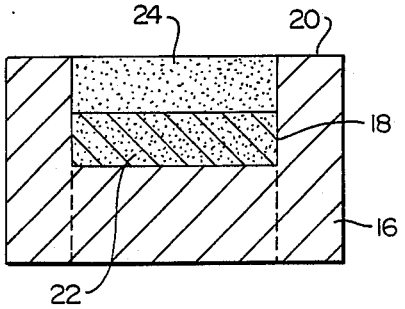
FIG. 2 illustrates a loaded cemented carbide cup used for producing the tool insert of FIG. 1.

The tool insert is manufactured using a cemented carbide cup as illustrated by FIG. 2. The cemented carbide cup 16 is circular in plan and has a recess 18 centrally located in one major surface 20 thereof. A mixture of the cubic boron nitride particles, tungsten carbide particles and powdered cobalt is placed in the recess 18 to form a first layer 22. The cubic boron nitride particles have an average size of less than 50 microns, the carbide particles have an average size of 2 to 6 microns, the powdered cobalt has an average particle size of less than 10 microns.

A mixture of diamond particles and cobalt powder is placed on top of the layer 22 to form a second layer 24. The diamond particles have an average size of less than 100 microns while the powdered cobalt was the same as that used for the mixture in the layer 22. The cobalt constituted 5 percent by weight of the diamond/cobalt mixture.

The carbide cup 16 was then placed in a suitable capsule and the capsule placed in the reaction zone of a conventional high temperature/high pressure apparatus. The contents of the capsule were subjected to a temperature of 1500° C. and a pressure of 55 kilobars and these conditions were maintained for a period of 15 minutes. The cup 16 was recovered from the capsule and the sides ground away to the dotted lines to product the insert illustrated by FIG. 1.

The tool insert of the invention was compared with a commercially available composite diamond abrasive compact. This commercially available composite diamond abrasive compact consisted of a diamond compact layer having a cobalt second phase and bonded directly to a cemented tungsten carbide support. The compact was produced by placing a mass of diamond particles in a cemented carbide cup of the type illustrated by FIG. 2. The loaded cup was placed in a capsule and that capsule placed in a high temperature/high pressure apparatus and the contents subjected to the same temperature and pressure conditions described above. Cobalt from the cemented carbide cup infiltrated into the diamond mass during compact manufacture. The sides of the recessed body 16 were removed to produce the composite compact or tool insert.

Figure 3:
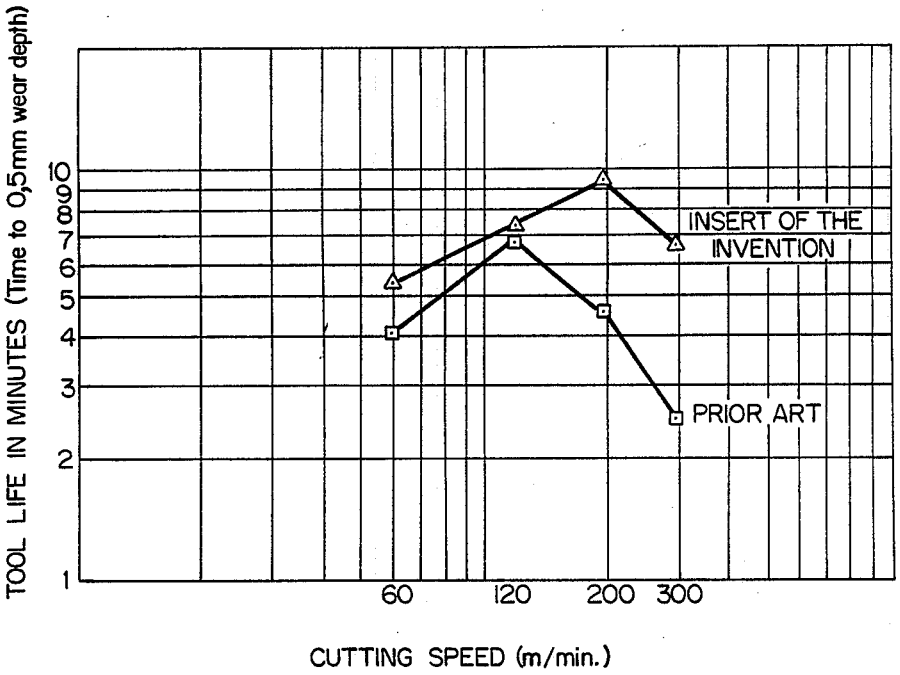
FIG. 3 illustrates graphically the results of some cutting tests.

The two tool inserts were subjected to a test in which they were both used to turn Paarl Granite at varying cutting speeds. The time taken from a 0.5 mm were flat to be produced was measured at speeds of 60 m/minute, 120 m/minute, 200 m/minute and 300 m/minute. The results are set out graphically in FIG. 3. It will be noted that the time taken for the wear flat to be produced on the tool insert of the invention was longer than that taken for the commercially used tool insert, particularly at higher cutting speeds. At higher cutting speeds, higher temperature and generated at the cutting edge, and this indicates that the tool insert of the invention is thermally more stable than the other tool insert. Two other tool inserts of the invention were produced using the method described above, save that in the first variant the diamond/cobalt mixture contained 1 percent by weight cobalt and in the second variant the diamond-/cobalt mixture contained 2.5 percent by weight cobalt. The three tool inserts were subjected to a turning test on Paarl Granite. Wear flats were measured at a cutting speed of 120 m/minute after a test time of 2 minutes. The inserts had been heat treated at 800° C., 830° C. and 850° C. in argon for 10 minutes prior to the turning test. The results are set out in Table 1.

TABLE 1

| Tool Insert | | Wear Flat Area ($mm^2$) | | |
|---|---|---|---|---|
| Intermediate Layer (Weight %) | Diamond Compact (Weight %) | 800° C. | 830° C. | 850° C. |
| 20% Co-WC-CBN | 1% Co Diamond | 1,08 | 1,06 | 1,06 |
| | | 1,04 | 1,00 | 1,37 |
| 20% Co-WC-CBN | 2,5% Co Diamond | 1,00 | 1,01 | 1,11 |
| | | 1,05 | 1,02 | 1,13 |
| 20% Co-Wc-CBN | 5% Co Diamond | 1,01 | 1,04 | 1,56 |
| | | 1,04 | 1,05 | — |

In each instance after 10 minutes of heating at the designated temperature, wear flats of relatively small area had been produced indicating satisfactory performance. In all cases, when the temperature of heat treatment was raised to 870° C., the inserts failed.

The tool inserts of the invention, as mentioned above, have particular application in drilling applications. High temperatures are often experienced by the inserts when they are brazed to carbide studs for incorporation into the working surface of drill bits and when such studs or the inserts themselves are brazed into the working surface of a drill bit. Further, high temperature are generated at the compact cutting edge during drilling. Thus, the thermal stability of the inserts of the invention gives the inserts a real advantage over similar inserts of the prior art.

The tool inserts may also be used for producing rotary drill bits, particularly rotary microdrill bits. The presence of the intermediate layer reduces the tendency for undercutting to occur during driling. Also, high temperatures are generated at the compact cutting edge during use of such drill bits.

We claim:

1. A tool insert comprising a diamond abrasive compact having a diamond solvent second phase and bonded to a cemented carbide support through an intermediate layer consisting essentially of discrete cubic boron nitride particles and carbide particles bonded together into a coherent form by means of a bonding metal selected from cobalt, nickel and iron and alloys containing one or more of these metals, the cubic boron nitride particles constituting 60 to 20 percent by volume of the intermediate layer, the carbide particles and bonding metal together constituting 40 to 80 percent by volume of the intermediate layer and the bonding metal constituting 15 to 25 percent by weight of the carbide/-metal combination.

2. A tool insert according to claim 1 wherein the intermediate layer has a thickness in the range 20 microns to 5 mm.

3. A tool insert according to claim 1 wherein the intermediate layer has a thickness substantially the same as that of the diamond abrasive compact.

4. A tool insert according to claim 1 wherein the diamond solvent is cobalt.

5. A tool insert according to claim 1 wherein the carbide particles are tungsten carbide particles.

6. A tool insert according to claim 1, wherein the intermediate layer consists essentially of 50% by volume of discrete cubic boron nitride particles, and 50% by volume of a combination of tungsten carbide particles and cobalt particles, the cobalt being present in an amount of 20% by weight of the carbide/cobolt combination.

7. A tool insert according to claim 6, wherein the cobolt particles have an average particle size of less than 10 microns.

8. A tool insert according to claim 1, wherein: the diamond solvent is cobolt particles having an average size of less than 10 microns; and the diamond abrasive compact further includes diamond particles having an average size of less than 100 microns.

9. A tool insert according to claim 1, wherein:

the carbide particles have an average size of less than 10 microns; and the cubic boron nitride particles have an average size of less than 50 microns.

10. A tool insert according to claim 9, wherein the carbide particles have an average size of between 2 and 6 microns.

11. A method of making a tool insert of the type comprising a diamond abrasive compact, a cemented carbide support and an intermediate layer, the method including the steps of providing a body of cemented carbide, placing a mixture of cubic boron nitride particles, carbide particles and powdered bonding metal on a surface of the carbide body, the cubic boron nitride particles constituting 60 to 20 percent by volume of the mixture, the carbide particles and bonding metal together constituting 40 to 80 percent by volume of the mixture and the bonding metal constituting 15 to 25 percent by weight of the carbide/metal combination, placing a mixture of diamond particles and powdered diamond solvent on the cubic boron nitride containing mixture, and subjecting the body and mixtures to conditions of elevated temperature and pressure suitable to produce the diamond abrasive compact of the diamond-/solvent mixture.

12. A method according to claim 11 wherein the body of cemented carbide has a recess formed in a surface thereof and the mixtures are placed in layers in the recess.

13. A method according to claim 11 wherein the diamond solvent for the diamond/solvent mixture is cobalt.

14. A method according to claim 11 wherein the diamond solvent is present in an amount of up to 5 percent by weight of the diamond/solvent mixture.

* * * * *

UNITED STATES PATENT AND TRADEMARK OFFICE

CERTIFICATE OF CORRECTION

PATENT NO. : 4,959,929

DATED : October 2, 1990

INVENTOR(S) : Richard Burnand, et al.

It is certified that error appears in the above-identified patent and that said Letters Patent is hereby corrected as shown below:

Column 2, line 63: "on" should read as --or--

Column 4, line 5: "product" should read as --produce--

Column 4, line 33: "and" should read as --are--

Column 4, line 55: "Wc" should read as --WC--

Column 5, line 10: "driling" should read as --drilling--

Column 4, line 33: "temperature" should read as --temperatures--.

Signed and Sealed this

Twenty-eighth Day of January, 1992

*Attest:*

HARRY F. MANBECK, JR.

*Attesting Officer*

*Commissioner of Patents and Trademarks*